US009552754B2

(12) United States Patent
Min et al.

(10) Patent No.: US 9,552,754 B2
(45) Date of Patent: Jan. 24, 2017

(54) DISPLAY METHOD AND DEVICE FOR OPTIMIZING SCREEN BRIGHTNESS

(71) Applicant: SAMSUNG ELECTRONICS CO., LTD., Suwon-si (KR)

(72) Inventors: Byung-Seok Min, Seoul (KR); Yong Kim, Osan-si (KR); Eun-Hyun Kim, Gumi-si (KR); Jong-Man Kim, Gunpo-si (KR); Jong-Ho Kim, Seoul (KR); Se-Hyeok Park, Seoul (KR); Jeong-Hoon Park, Seoul (KR); Hyun-Hee Park, Seoul (KR); Min-Woo Lee, Yongin-si (KR); Ji-Young Yi, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 180 days.

(21) Appl. No.: 14/141,041

(22) Filed: Dec. 26, 2013

(65) Prior Publication Data

US 2014/0176518 A1 Jun. 26, 2014

(30) Foreign Application Priority Data

Dec. 26, 2012 (KR) ..... 10-2012-0153815

(51) Int. Cl.
*G09G 3/20* (2006.01)

(52) U.S. Cl.
CPC ..... *G09G 3/20* (2013.01); *G09G 2320/0247* (2013.01); *G09G 2320/068* (2013.01); *G09G 2320/0626* (2013.01); *G09G 2340/16* (2013.01); *G09G 2354/00* (2013.01); *G09G 2360/144* (2013.01)

(58) Field of Classification Search
CPC ..... G09G 2360/14–2360/148
USPC ..... 345/162, 204, 207
See application file for complete search history.

(56) References Cited

U.S. PATENT DOCUMENTS

2008/0165116 A1 7/2008 Herz et al.
2008/0186294 A1* 8/2008 Lee ..... G09G 3/3406 345/207
2008/0186707 A1 8/2008 Ku et al.
2008/0291139 A1* 11/2008 Hsieh ..... G09G 3/20 345/77
2009/0262128 A1* 10/2009 Gettemy ..... G09G 3/22 345/589

FOREIGN PATENT DOCUMENTS

CN 101883210 B * 10/2012

* cited by examiner

*Primary Examiner* — Carolyn R Edwards
(74) *Attorney, Agent, or Firm* — Sughrue Mion, PLLC

(57) ABSTRACT

A display method and a display device for optimizing screen brightness of a mobile terminal are provided. The display method includes: determining an external illuminance value based on a sensor signal by detecting by the sensor signal for determining a brightness value of a screen; determining the brightness value of the screen corresponding to the external illuminance value; and outputting an image signal by using the brightness value of the screen.

15 Claims, 7 Drawing Sheets

DISPLAY METHOD AND DEVICE FOR OPTIMIZING SCREEN BRIGHTNESS

PRIORITY

This application claims priority from Korean Application Serial No. 10-2012-0153815, which was filed in the Korean Intellectual Property Office on Dec. 26, 2012, the entire content of which is hereby incorporated by reference, in its entirety.

BACKGROUND

1. Technical Field

Aspects of the exemplary embodiments generally relate to a display method and device. More particularly, the exemplary embodiments relate to a display method and device for optimizing screen brightness according to an amount of illuminance.

2. Description of the Related Art

Currently, as various display devices such as a mobile phone, a notebook, a tablet PC and the like (hereinafter, referred to as a "mobile terminal") become common, a picture quality as well as a function thereof is considered as being important. Among various elements influencing the picture quality of the display device, proper screen brightness is a non-negligible element. If the screen brightness is automatically controlled according to external illuminance, user satisfaction may increase and power consumption may be reduced.

The display device of the related art uses fixed screen brightness or uses screen brightness controlled by the user. However, when a fixed screen brightness is used, since unnecessary power consumption is high during high external illuminance and higher screen brightness cannot be obtained in a darker environment, this results in inconvenience in using the display apparatus. For example, due to a difference of illuminance between day and night or a sunny day and a cloudy day, screen brightness of the display device becomes different from surrounding brightness, which makes a user experience great amount of eye strain.

Further, when a user manually controls the screen brightness, the user who is not skilled has difficulty in properly controlling the screen brightness. For example, the user may control the screen brightness such that the brightness is too bright or too dark compared to the surrounding illuminance.

The screen brightness suitable for the display device of the mobile terminal may vary, depending on a position or an angle of the mobile terminal held by the user. However, there is no method in the related art capable of controlling the screen brightness in consideration of an incident angle. Accordingly, even though the user controls the screen brightness, the controlled screen brightness may not be proper, depending on an angle at which the user views the corresponding display device. Therefore, there is a requirement to provide a method capable of automatically controlling the screen brightness in consideration of an incident angle of illumination of the display device in the related art.

SUMMARY

The exemplary embodiments provide a display method and a device for optimizing screen brightness.

The exemplary embodiments also provide a display method and device for optimizing screen brightness, according to an amount of illuminance from an incident angle of light.

The exemplary embodiments provide a display method and device for controlling screen brightness in accordance with an incident angle of light.

In accordance with an aspect of the exemplary embodiments, a display method of a mobile terminal is provided. The display method includes determining an external illuminance value based on a sensor signal by detecting the sensor signal for determining a brightness value of a screen; determining the brightness value of the screen corresponding to the value of the external illuminance; and outputting an image signal by using the brightness value.

In accordance with another aspect of the exemplary embodiments, a display device of a mobile terminal is provided. The display device includes a sensor configured to output a sensor signal for determining a brightness value of a screen; a display controller configured to determine an external illuminance value based on the sensor signal and determine the brightness value of the screen corresponding to the external illuminance value; and a display configured to output an image signal by using the brightness value of the screen.

The exemplary embodiments have an effect of automatically controlling screen brightness in accordance with an amount of illuminance in a display device. Further, the exemplary embodiments have the effect of controlling a flicker phenomenon of the screen according to a sudden illuminance change and has an advantage that soft screen switching may be achieved according to a change in brightness.

An aspect of an exemplary embodiment may provide a display device for optimizing screen brightness, the display device including: a sensor configured to output a sensor signal; a display controller configured to detect the output sensor signal and determine an external illuminance value based on the detected sensor signal, and determine a brightness value of a screen which corresponds to the external illuminance value; wherein the display controller is configured to perform a noise removal operation based on the determined brightness value of the screen and a currently set brightness value of the screen.

The display controller may be configured to determine the brightness value of the screen which corresponds to the external illuminance value, based on information related to the brightness value of the screen for each of a plurality of external illuminance values.

The sensor may include at least one of an illuminance sensor, a color sensor, a motion sensor and a human body recognition sensor.

The display controller may be configured to sort data included in a window where noise is detected in an ascending order based on a size of the brightness value, in response to the currently set brightness value of the screen being changed into the determined brightness value of the screen.

The display apparatus may further include a display configured to output an image signal by using the determined brightness value of the screen.

DETAILED DESCRIPTION OF THE EXEMPLARY EMBODIMENTS

Hereinafter, the principle of operation of the exemplary embodiments will be described in detail with reference to the accompanying drawings. In the following description of the exemplary embodiments, a detailed description of known functions and configurations incorporated herein will be omitted when it may make the subject matter of the exemplary embodiments rather unclear. Further, the terms described below are terms defined by considering functions in the exemplary embodiments may be changed according to the operator's intention, practice, or the like. Therefore, definitions thereof should be made based on contents throughout the specification.

Hereinafter, various exemplary embodiments will be described with reference to the accompanying drawings. Further, in the following description, a detailed description of known functions and configurations incorporated herein will be omitted when it may make the subject matter of the present invention rather unclear.

The exemplary embodiments relate to a display method and device for optimizing screen brightness. Specifically, the exemplary embodiments suggest a display method and device for optimizing screen brightness according to an amount of illuminance. The display device suggested by an exemplary embodiment may be included in devices of which a position or an angle may be changed by a user, such as a mobile phone, a notebook, a tablet PC and the like. Hereinafter, for convenience of description, the device, including the display device, will be referred to as a mobile terminal.

Figure 1:
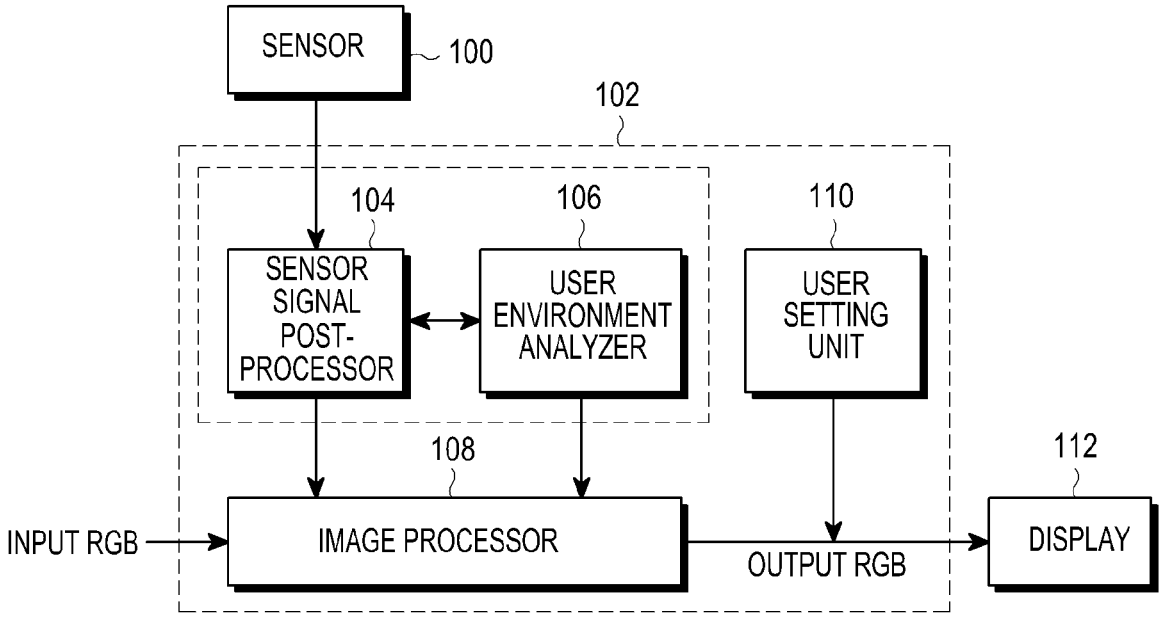
FIG. 1 is a block diagram of a display device according to an exemplary embodiment.

FIG. 1 is a block diagram of a display device according to an exemplary embodiment.

Referring to FIG. 1, the display device includes a sensor 100, a display controller 102, and a display 112.

The sensor 100 may include an illuminance sensor, a color sensor, a motion sensor, a human body recognizing sensor, and the like, as components for recognizing a motion or an angle of the mobile terminal, including the display device, a color of a light, or whether the user experiences a glare phenomenon. The illuminance sensor detects surrounding brightness, the color sensor detects a color of a light, and the motion sensor measures a motion of the mobile terminal and may include an acceleration sensor, a gyro sensor, or the like. Further, the human body recognizing sensor recognizes an eye, a face, or the like, of the user and detects whether there is the glare phenomenon based on a pupil size, a facial expression, or the like, of the user. The human body recognizing sensor may be included in, for example, a camera, or the like, installed in the mobile terminal.

The sensor 100 outputs at least one of a sensor signal containing illuminance information related to the brightness measured by the illuminance sensor, a sensor signal which contains information related to a color of the light measured by the color sensor, a sensor signal containing information related to a motion (a movement distance or direction, an angle, or the like) of the mobile terminal, and a sensor signal containing information related to a degree of the glare experienced by the user. The sensor signal output from the sensor 100 is input into the display controller 102.

The display controller 102 determines a degree of the motion of the mobile terminal, a state of the glare of the user, chroma information, illuminance information, and the like, based on the sensor signal, and determines an illuminance value which corresponds to the degree of the motion of the mobile terminal, the state of the glare of the user, the chroma information, the illuminance information, and the like, as an external illuminance value. The display controller 102 determines a degree of the illuminance value in an environment where the user is located, based on the external illuminance value. Further, in response to the display controller 102 receiving an image signal such as an image, a video, or the like, the display controller 102 performs noise processing on the received image signal, adjusts brightness of the screen in accordance with the determined external illuminance values, and then outputs the image signal.

In order to perform the above operations, the display controller 102 includes a sensor signal post-processor 104, a user environment analyzer 106, an image processor 108, and a user setting unit 110.

The sensor signal post-processor 104 receives the sensor signal, and outputs information (the motion degree of the mobile terminal, the glare state of the user, the chroma information and the illuminance information) contained in the sensor signal, to the user environment analyzer 106. Then, the user environment analyzer 106 detects the external illuminance value based on the information output from the sensor signal post-processor 104. Unlike FIG. 1, the user environment analyzer 106 may directly receive the sensor signal output from the sensor 100 and can detect information contained in the received sensor signal.

The external illuminance value may be detected, for example, by the following method.

Figure 2A:
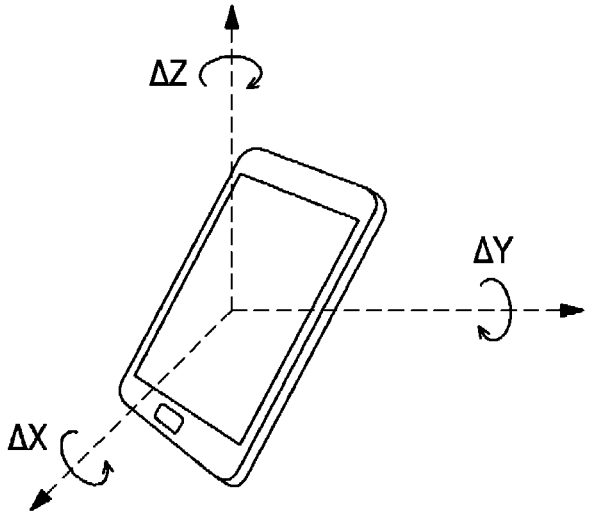
FIGS. 2A and 2B are diagrams which illustrate an external illuminance value which corresponds to a motion angle of a mobile terminal, according to an exemplary embodiment.
Figure 2B:
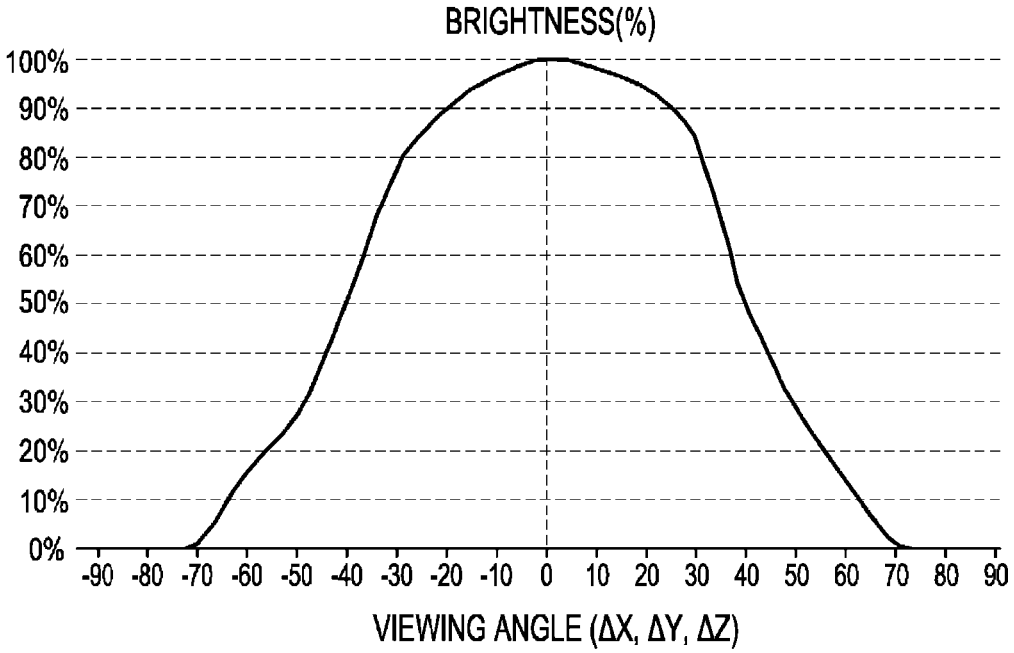

In response to motion information (movement distance or direction, angle or the like) of the mobile terminal being contained in the sensor signal, the user environment analyzer 106 detects an external illuminance value which corresponds to the motion information of the mobile terminal, based on a table including a brightness value for each motion information. In response to a motion angle (viewing angle information) of the mobile terminal being measured as illustrated in FIG. 2A, an external illuminance value which corresponds to the motion angle may be detected by using the graph illustrated in FIG. 2B.

Figure 3:
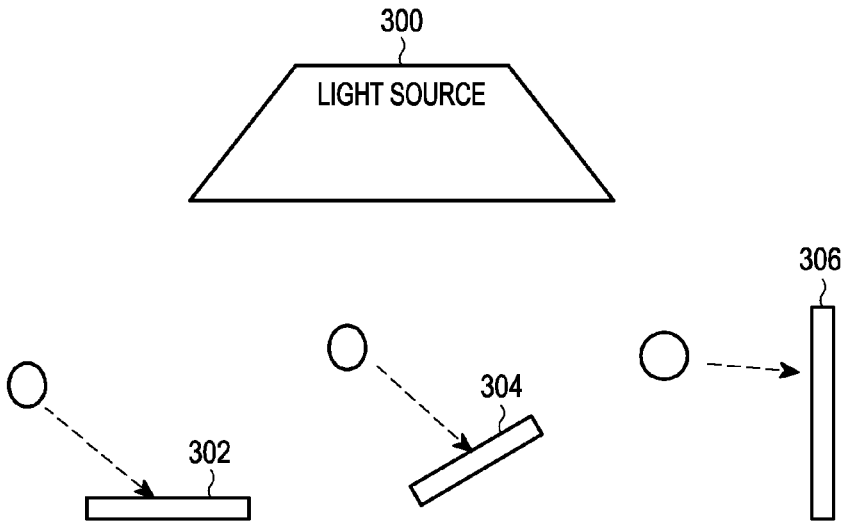
FIG. 3 is a diagram which illustrates an illumination incident angle which influences illuminance information, according to an exemplary embodiment.

In response to the illuminance information being contained in the sensor signal, the user environment analyzer 106 detects the external illuminance value based on a brightness value for each value of illuminance information. Here, the illuminance information may vary, depending on an illumination incident angle, as illustrated in FIG. 3. That is, since an amount (intensity) of the light penetrating the screen of the mobile terminal becomes different according to whether the mobile terminal is laid flat 302, the mobile terminal is slanted 304, or the mobile terminal is upright 306, even though a light source 300 is fixed, the illuminance information may become different according to the amount of light.

In response to the information related to the degree of glare of the user being contained in the sensor signal, the user environment analyzer 106 detects the external illuminance value based on a table which includes a brightness value for each degree of glare. Further, in response to the information related to the color of the light being contained in the sensor signal, the user environment analyzer 106 detects the external illuminance value based on a table which includes a brightness value which corresponds to the chroma information.

In response to the external illuminance value being detected as described above, the user environment analyzer 106 determines the brightness value of the screen which corresponds to the detected external illuminance value. At this time, the user environment analyzer 106 may determine the brightness value of the screen which corresponds to the external illuminance value, based on the table including the brightness value of the screen for each external illuminance value. The determined brightness value of the screen may be output to the sensor signal post-processor 104 and the image processor 108.

Meanwhile, although not illustrated in FIG. 1, the user environment analyzer 106 may include a brightness compensator as a separate physical component for determining the brightness value of the screen. Further, the brightness value for each motion information, the brightness value for each illumination information, the brightness value according to the degree of glare, and the brightness value for each chroma information used for detecting the external illuminance value, may be preset or may be values previously set by the user.

In response to the brightness value of the screen output from the user environment analyzer 106 being input, the sensor signal post-processor 104 performs a noise processing operation of smoothly performing screen switching, according to a brightness change.

That is, the sensor signal post-processor 104 performs the operation which smoothly and gradually switches the currently screen brightness to a brightness which corresponds to the input screen brightness value. A control signal according to the noise processing operation is output to the image processor 108, and the noise processing operation will be described below in more detail.

In response to an image signal such as an image, a video or the like being input, the image processor 108 controls the brightness of the screen by using the brightness value output from the user environment analyzer 106 according to the control signal output from the sensor signal post-processor 104. Further, the image processor 108 performs a flicker removal operation, a white balance control operation, and the like.

The image signal output from the image processor 108 may be directly output to and displayed on display 112. The image signal of which brightness is controlled according to a setting by the user can be displayed on display 112. For example, one of an automatic mode in which the image signal output from the image processor 108 is directly output to and displayed on display 112 and a manual mode in which the image signal of which the brightness is controlled by the user is displayed on display 112, may be used by selection of the user. Further, a combination of the automatic mode and the manual mode may be used. In this case, the brightness can be additionally controlled by a user setting while the automatic mode is executed.

The user setting unit 110 may be included in the display controller 102 in order to allow the user to directly set the brightness of the screen. The user setting unit 110 controls brightness, chroma, and the like, according to a user input.

The noise processing operation performed by the sensor signal processor 104 may be described with reference to FIGS. 4 to 7.

Figure 4:
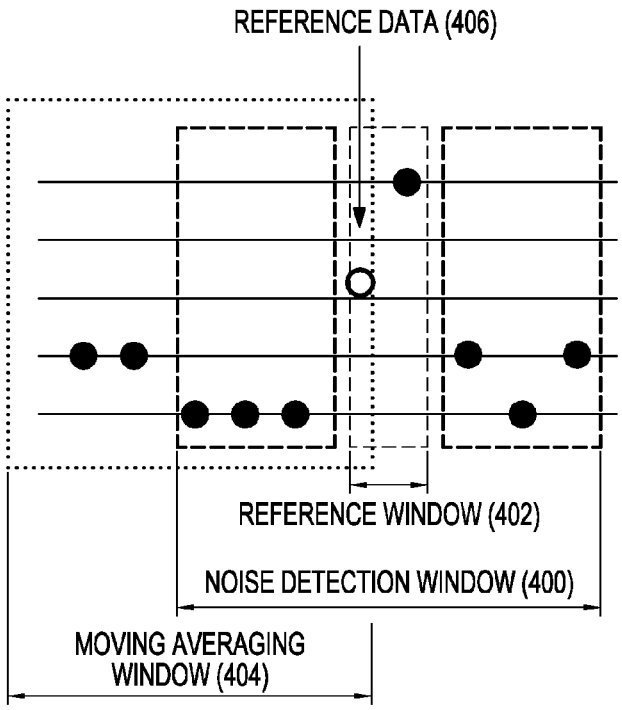
FIG. 4 is a diagram which illustrates a window configuration in which noise processing is performed, according to an exemplary embodiment.

FIG. 4 is a diagram which illustrates a window configuration in which noise processing is performed, according to an exemplary embodiment.

In FIG. 4, a horizontal axis indicates a window size, and a vertical axis indicates a brightness value (lux) of the screen of the mobile terminal, according to a change in illuminance. The sensor signal post-processor 104 determines a size (N) of a noise detection window 400 and a size (M) of a reference window 402. The size (N) of the noise detection window 400 and the size (M) of the reference window 402 may be set by the user or by the sensor signal processor 104. Further, the noise detection window 400 may be a window having a brightness value which has a greatest difference from a brightness value of a moving average window 404.

The sensor signal post-processor 104 sorts data included in the noise detection window 400 in an ascending order, based on the brightness value. The sensor signal post-processor 104 calculates an average value (moving average value) of M data (that is, data which corresponds to the size of the reference window 402) located in the middle of the noise detection window 400 among the sorted data. In addition, the sensor signal processor 104 updates first data 406 of the M data to the calculated average value.

The above noise processing method may be used in response to the illuminance change being generated or the flicker illuminance change being generated. The illuminance changes will be described below in detail with reference to FIGS. 5A and 5B.

Figure 5A:
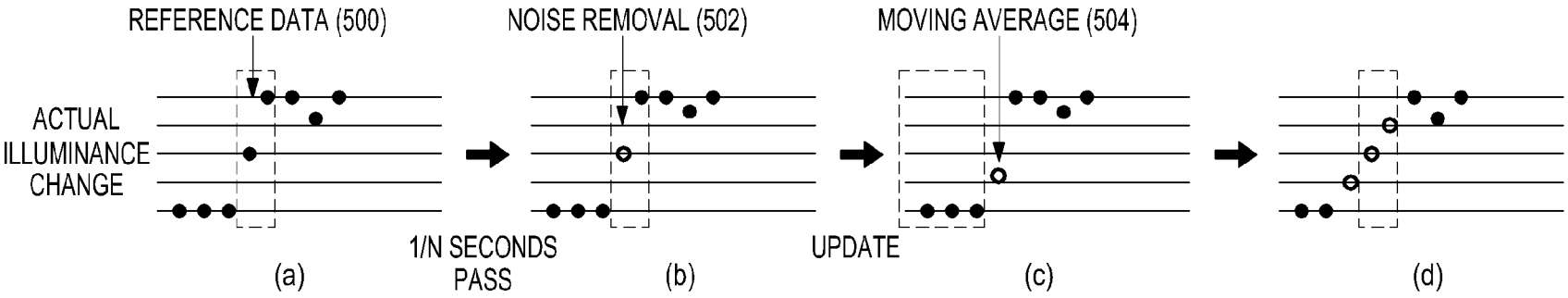
FIG. 5A is a diagram which illustrates a process of performing a noise processing operation, according to a general change in illuminance, according to an exemplary embodiment.

FIG. 5A is a diagram which illustrates a process of performing a noise processing operation, according to a general changes in illuminance, according to an exemplary embodiment.

The general change in illuminance refers to a state where a change of illuminance value is maintained for a predetermined period of time, or longer. For example, in response to a state where indoor illumination is turned off and then turned on (or the indoor illumination is turned on and then turned off) or is maintained for a preset period of time, or longer, the state may be determined as the general change of illuminance.

The sensor signal post-processor 104 detects reference data 500 as illustrated in (a) of FIG. 5A. The sensor signal post-processor 104 sorts the data included in the noise detection window in an ascending order, according to the brightness value, and detects M data located in the middle of the sorted data. Further, the sensor signal post-processor 104 detects first data of the M data as the reference data 500.

The sensor signal post-processor 104 performs a noise removal operation 502, as illustrated in (b) of FIG. 5A, after a preset period of time (for example, 1/N second) passes. The noise removal operation 502 refers to an operation of updating the reference data 500 to have an average value of the M data.

When the above update operation is performed, the reference data 500 has a moving average value of the brightness value, as illustrated in (c) of FIG. 5A. Further, in response to all operations such as (a) to (c) of FIG. 5A being performed for the M data in the unit of the preset period of time, a change of brightness value smoothly occurs, as illustrated in (d) of FIG. 5A. That is, the change in screen brightness according to the illuminance change occurs more naturally.

Meanwhile, as the illuminance change becomes larger, the screen brightness may be suddenly changed. In response to the screen brightness being suddenly changed, a screen flicker phenomenon may be generated. As described above, the illuminance change causing the screen flicker phenomenon is called the flicker illuminance change.

Figure 5B:
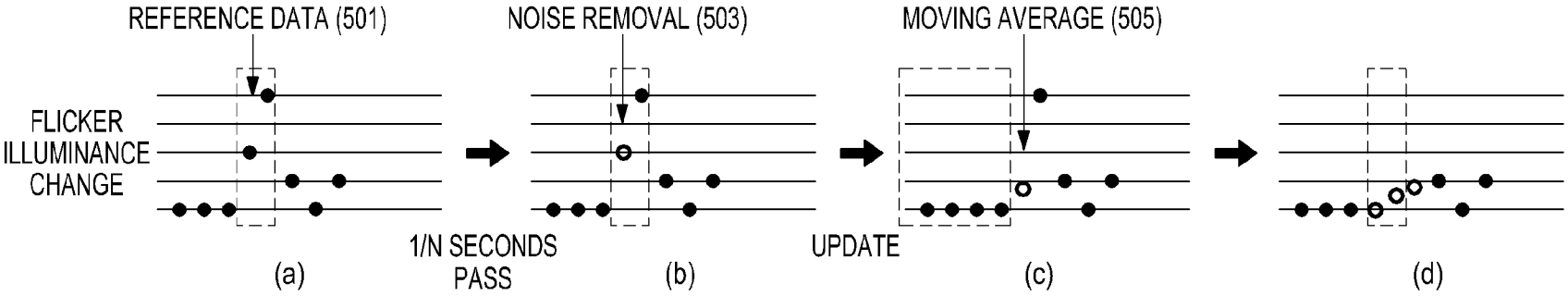
FIG. 5B is a diagram which illustrates a process of performing a noise processing operation, according to a change in flicker illuminance, according to an exemplary embodiment.

FIG. 5B is a diagram which illustrates a process of performing a noise processing operation, according to the flicker illuminance change, according to an exemplary embodiment. The process illustrated in FIG. 5B may be performed in a similar way to the process illustrated in FIG. 5A.

The sensor signal post-processor 104 detects reference data 501 as illustrated in (a) of FIG. 5B. The sensor signal post-processor 104 sorts data included in the noise detection window in an ascending order according to the brightness value, and detects M data located in the middle of the sorted data. Further, the sensor signal post-processor 104 detects first data of the M data as the reference data 501.

The sensor signal post-processor 104 performs a noise removal operation 503 as illustrated in (b) of FIG. 5B after a preset period of time (for example, 1/N second) passes. The noise removal operation 503 refers to an operation of updating the reference data 501 to have an average value of the M data.

When the above update operation is performed, the reference data 501 has a moving average value of the brightness value, as illustrated in (c) of FIG. 5B. Further, when all operations such as (a) to (c) of FIG. 5B are performed for all the M data, a brightness value change smoothly occurs as illustrated in (d) of FIG. 5B. That is, it is possible to prevent the flicker phenomenon due to the flicker illuminance change by controlling the illuminance value which causes the screen flicker phenomenon.

Figure 6:
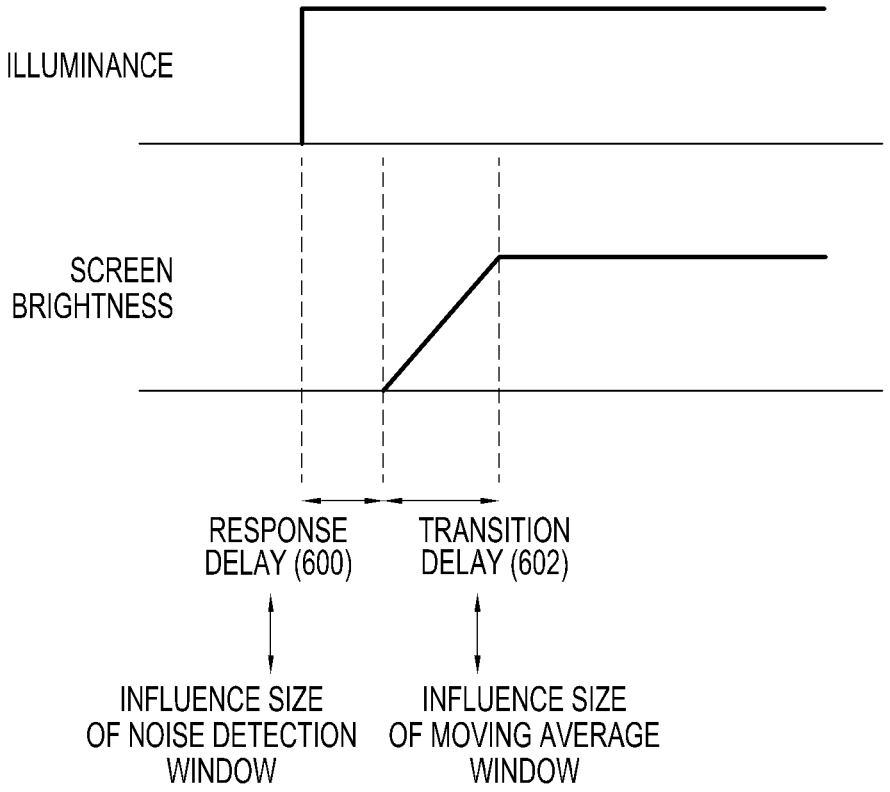
FIG. 6 is a graph which illustrates a change in screen brightness according to a change in illuminance, according to an exemplary embodiment.

FIG. 6 is a graph illustrating a screen brightness change according to an illuminance change according to an exemplary embodiment.

In an exemplary embodiment, in response to the change in illuminance being generated, the screen brightness is changed after a predetermined period of time passes from a point of time point when the change of illuminance is generated. For example, as illustrated in FIG. 6, in response to the illuminance value becoming larger, the screen brightness value of the mobile terminal becomes larger in accordance with the larger illuminance value, after a predetermined period of time passes. This is because it takes time to make the smooth screen brightness change occur.

The time to make the smooth screen brightness change occur may include a response delay time 600 and a transition delay time 602. The response delay time 600 may include a period of time taken until the aforementioned noise processing process is completed after the illuminance information is detected through the sensor 100 and the brightness value to be changed is determined. Accordingly, the response delay time 600 is affected by the size of the noise detection window.

Meanwhile, the transition delay time 602 includes a time for which the brightness change is actually achieved. Accordingly, the transition delay time 602 is affected by the size of the moving average window (including the data updated to the moving average value).

Hereinafter, a method of controlling a flicker of the screen according to an exemplary embodiment will be described with reference to FIG. 7.

Figure 7:
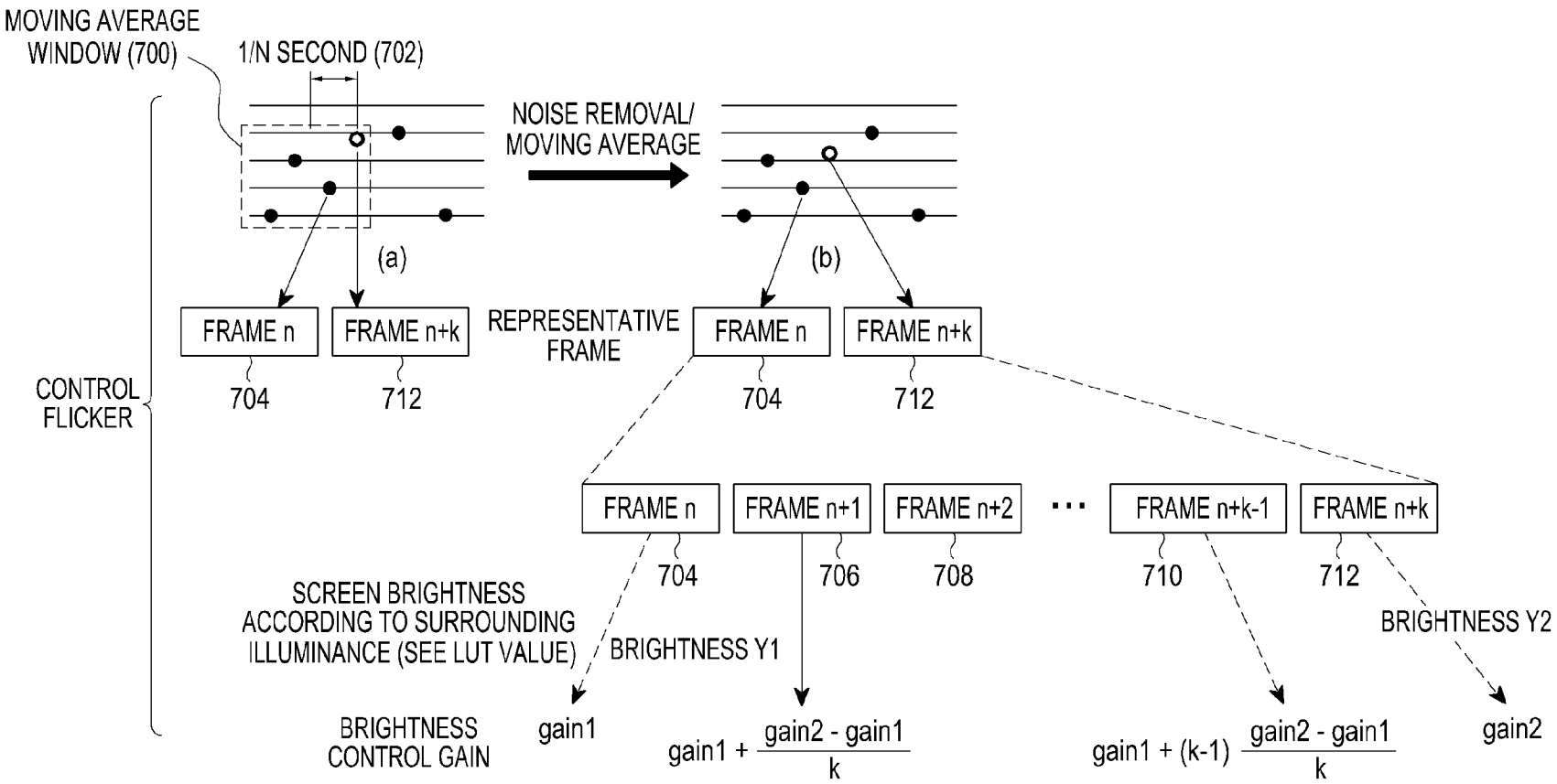
FIG. 7 is a diagram which illustrates a method of controlling a flicker of a screen, according to an exemplary embodiment.

FIG. 7 is a diagram which illustrates a method of controlling a flicker of the screen, according to an exemplary embodiment. The method of controlling the flicker of the screen may be performed by the image processor 108, illustrated in FIG. 1.

FIGS. (a) and (b) of FIG. 7 illustrate the noise processing process illustrated in FIGS. 5A and 5B.

In (a) of FIG. 7, for data of frame n 704 and data of frame n+k 712 among data included in a moving average window 700, the noise processing process may be performed in the unit of 1/N seconds 702. Then, as illustrated in (b) of FIG. 7, brightness values of the data of frame n 704 and the data of frame n+k 712 are updated and changed into the moving average value.

In an exemplary embodiment, in order to control the flicker phenomenon of the screen, a plurality of frame data including the data of frame n 704 and the data of frame n+k 712 are generated. That is, the data of frame n 704, data of frame n+1 706, data of frame n+2 708, . . . , data of frame n+k−1 710, and the data of frame n+k 712 are generated. Further, brightness values between the determined brightness value Y1 of the data of frame n 704 and the determined brightness value Y2 of the data of frame n+k 712 are determined as brightness values of the data of frame n+1 706, the data of frame n+2 708, . . . , the data of frame n+k−1 710, respectively.

For example, in response to a gain of the brightness value of the data of frame n 704 corresponding to gain 1, the brightness value of the data of frame n+1 706 may be determined to have a gain determined by using equation (1) below.

$$\text{gain1} + \frac{\text{gain2} - \text{gain1}}{k} \tag{1}$$

In equation (1), gain 1 denotes a gain of the brightness value of the data 704 of frame n, gain 2 denotes a gain of the brightness value of the data 712 of frame n+k, and k denotes the number of frames including frame n+1 706 through frame n+k 712.

Further, the brightness value of the data 712 of frame n+k−1 may be determined to have a gain determined by using equation (2) below.

$$\text{gain1} + (k-1)\frac{\text{gain2} - \text{gain1}}{k} \tag{2}$$

When the flicker control operation is performed, the screen flicker phenomenon may be prevented and the screen switching according to the brightness change may also be more smoothly achieved.

Meanwhile, for example, in the above flicker control operation, in response to the sensor signal being sampled four times per second, the gain of the brightness value may be set after updating the noise processing/moving average value every fifteenth frame data (first frame data, sixteenth frame data, thirty-first frame data, and the like). Further, brightness values of the frame data (second frame data to fifteenth frame data, seventeenth frame data to thirtieth frame data and the like) between the frame data of which the gain is set may be determined as interpolated gain values; that is, the brightness value of the frame data of which the gain is set may be determined as the gain value interpolated using the gain.

Figure 8:
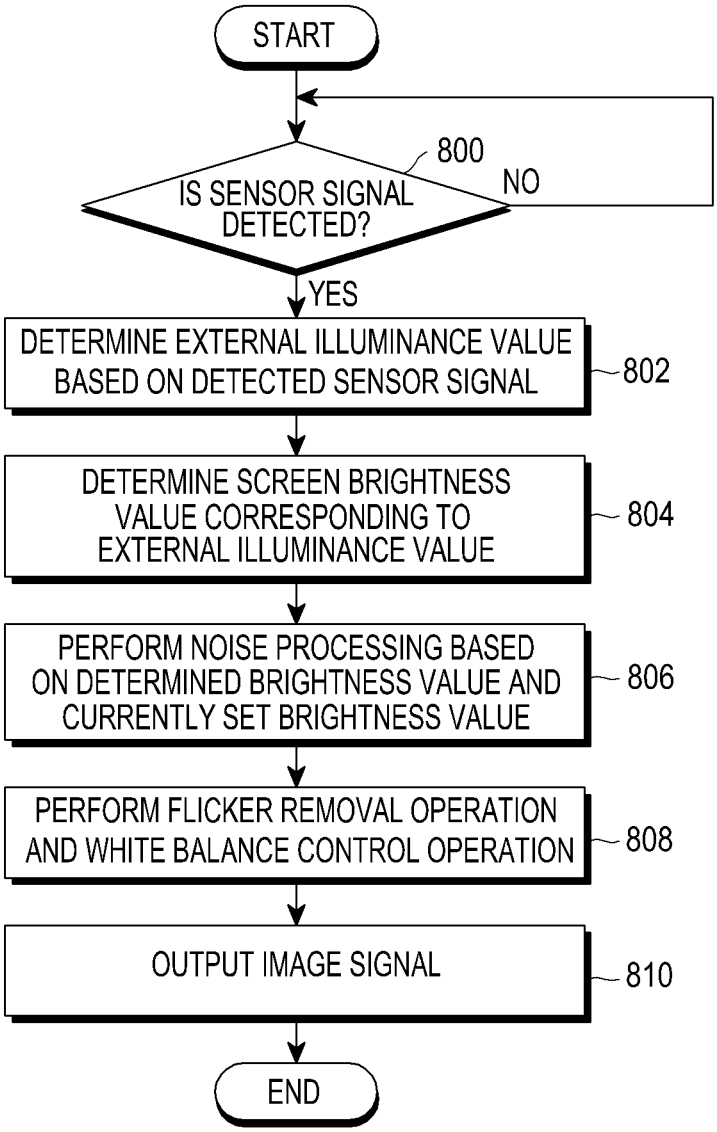
FIG. 8 is a flowchart which illustrates a display method, according to an exemplary embodiment.

FIG. 8 is a flowchart which illustrates a display method according to an exemplary embodiment.

Referring to FIG. 8, the display device determines whether the sensor signal for determining a brightness value is detected through the sensor in step 800. The sensor signal may include at least one of a sensor signal containing illuminance information, a sensor signal containing information related to a color of the light, a sensor signal containing motion information related to the mobile terminal, and a sensor signal containing information related to a degree of glare experienced by the user.

In response to the sensor signal being detected, the display device determines an external illuminance value based on the sensor signal in step 802. That is, the display device determines a degree of the illuminance value in an environment where the user is located, based on a degree of motion of the mobile terminal, a state of the glare experienced by the user, chroma information, illuminance information, and the like.

Subsequently, the display device determines a brightness value of the screen which corresponds to the determined external illuminance value in step 804. For example, the display device may determine the brightness value of the screen which corresponds to the environment of the user based on a table including the brightness value for each external illuminance value.

The display device performs a noise processing process based on currently set brightness value of the screen and the determined brightness value of the screen in step 806. The noise processing process may be performed as illustrated in FIGS. 4 to 6.

Further, the display device performs a flicker removal operation and a white balance control operation for an input image signal in step 808, and then outputs the input image signal in step 810.

Although not illustrated, in response to there being an additional brightness control by the user, the display device may change the brightness value of the screen according to the control of the user and then output the corresponding image signal. Further, the display device can perform the operation divisibly into an automatic mode in which the image signal is output according to the process of FIG. 8 and a manual mode in which the brightness of the screen is controlled by the user.

While the present invention has been shown and described with reference to certain embodiments thereof, it will be understood by those skilled in the art that various changes in form and details may be made therein without departing from the spirit and scope of the exemplary embodiments as defined by the appended claims. Therefore, the scope of the present invention should not be defined as being limited to the exemplary embodiments, but should be defined by the appended claims and equivalents thereof.

What is claimed is:

1. A display method of a mobile terminal, the display method comprising:

determining an external illuminance value based on a sensor signal;

determining a brightness value of a screen corresponding to the external illuminance value;

identifying a window where a noise is detected in the screen based on a currently set brightness value of the screen and the determined brightness value of the screen, the window including a plurality of data units related to an image signal to be display for a time period;

calculating an average brightness value of a preset number of data units among the plurality of data units;

performing a noise processing for the image signal by updating a brightness value of at least one of the preset number of data units to the average brightness value; and outputting the noise processed image signal.

2. The display method of claim 1, wherein the determining the external illuminance value comprises:

identifying sensor information including at least one of brightness information, chroma information, motion information of the mobile terminal, and information indicating a degree of glare experienced by a user, based on the sensor signal; and determining the external illuminance value based on the sensor information.

3. The display method of claim 1, wherein determining the brightness value of the screen corresponding to the external illuminance value comprises determining the brightness value of the screen corresponding to the external illuminance value based on information related to a brightness value of the screen for each of a plurality of external illuminance values.

4. The display method of claim 1, wherein the calculating the average brightness value comprises:

sorting the plurality of data units to increase a brightness value according to a time; and calculating the average value of the preset number of data units to be displayed for a specific time in the time period among the sorted data units.

5. The display method of claim 1, wherein the at least one data unit of which the brightness value is updated to the average value includes a data unit to be firstly displayed among the preset number of data units.

6. The display method of claim 1, wherein the outputting the noise processed image signal comprises:

setting a first gain of a brightness value for a first frame in the time period and a second gain of a brightness value for a second frame in the time period;

performing a flicker control operation for the noise processed image signal by setting gains of frames between the first frame and the second frame based on the first gain and the second gain; and outputting the noise processed image signal based on a result of the flicker control operation.

7. The display method of claim 1, further comprising:

determining whether there is an input for controlling a brightness value of the screen after determining the brightness value of the screen; and outputting the image signal based on the brightness value of the screen according to the input in response to there being an input.

8. A display device of a mobile terminal, the display device comprising:

a sensor configured to output a sensor signal;

a display controller configured to determine an external illuminance value based on the sensor signal, determine a brightness value of a screen corresponding to the external illuminance value, to identify a window where a noise is detected in the screen based on a currently set brightness value of the screen and the determined brightness value of the screen, the window including a plurality of data units related to an image signal to be displayed for a time period, to calculate an average brightness value of a preset number of data units among the plurality of data units, and to perform a noise processing for the image signal by updating a brightness value of at least one of the preset number of data units to the average brightness value; and a display configured to output the noise processed image signal.

9. The display device of claim 8, wherein the sensor comprises at least one of an illuminance sensor configured to measure external brightness, a color sensor configured to measure a color of a light, a motion sensor configured to measure a motion of the mobile terminal, and a human body recognition sensor configured to detect the degree of glare experienced by the user.

10. The display device of claim 8, wherein the display controller is configured to determine the brightness value of the screen corresponding to the external illuminance value, based on information related to the brightness value of the screen for each of a plurality of external illuminance values.

11. The display device of claim 8, wherein the display controller is configured to identify sensor information including at least one of brightness information, chroma information, motion information of the mobile terminal, and information indicating a degree of glare experienced by a user, based on the sensor signal, and determine the external illuminance value based on the sensor information.

12. The display device of claim 8, wherein the display controller is configured to sort the plurality of data units to increase a brightness value according to a time, and to calculate the average value of the preset number of data units to be displayed for a specific time in the time period among the sorted data units.

13. The display device of claim 8, wherein the at least one data unit of which the brightness value is updated to the average value includes a data unit to be firstly displayed among the preset number of data units.

14. The display device of claim 8, wherein the display controller is configured to set a first gain of a brightness value for a first frame in the time period and a second gain of a brightness value for a second frame in the time period, and to perform a flicker control operation for the noise processed image signal by setting gains of frames between the first frame and the second frame based on the first gain.

15. The display device of claim 8, wherein the display controller is configured to determine whether there is an input for controlling a brightness value of the screen after the brightness value of the screen is determined, and to control the display to output the image signal based on the brightness value of the screen according to the input in response to there being an input.

* * * * *